United States Patent [19]

Mason

[11] Patent Number: 4,937,940

[45] Date of Patent: Jul. 3, 1990

[54] RAZOR CLEANING IMPLEMENT

[76] Inventor: Robert J. Mason, 19 Wells Pl., Lynn, Mass. 01902

[21] Appl. No.: 340,311

[22] Filed: Apr. 19, 1989

[51] Int. Cl.[5] ..... B26B 19/48; B26B 1/00; B26B 9/02; B26B 3/00

[52] U.S. Cl. ..... 30/169; 30/41; 30/136; 30/329

[58] Field of Search ..... 30/41, 169, 171, 136, 30/329; 15/236 R; 132/321, 328; 206/380

[56] References Cited

U.S. PATENT DOCUMENTS

| | | | |
|---|---|---|---|
| 1,527,845 | 2/1925 | Daniel | 132/321 |
| 2,380,855 | 7/1945 | Lower | 30/169 |
| 3,050,072 | 8/1962 | Diener | 132/321 |
| 3,660,902 | 5/1972 | Axelsson | 132/321 |
| 4,226,019 | 10/1980 | Sugiyama | 30/41 |
| 4,300,285 | 11/1981 | Endo | 30/41 |
| 4,377,381 | 3/1983 | Westman | 132/321 |
| 4,395,822 | 8/1983 | Ciaffone | 30/41 |
| 4,438,767 | 3/1984 | Nelson | 30/169 |
| 4,480,387 | 11/1984 | d'Alayer de Costemore d'Arc | 30/41 |
| 4,800,905 | 1/1989 | Stuart | 132/321 |

*Primary Examiner*—Douglas D. Watts
*Assistant Examiner*—Paul M. Heyrana, Sr.
*Attorney, Agent, or Firm*—Henderson & Sturm

[57] ABSTRACT

A razor cleaning implement (10) used to remove the accumulated debris between the blades (102) of a twin bladed razor (100) wherein the implement (10) includes a cleaning head element (21) mounted on a shaft (22) which is attached to an enlarged gripping member (13).

1 Claim, 1 Drawing Sheet

RAZOR CLEANING IMPLEMENT

TECHNICAL FIELD

The present invention relates generally to the field of razor blade cleaning apparatus, and more particularly to a detached hand manipulable implement for removing clogged hair cuttings from the vicinity of a razor blade.

BACKGROUND OF THE INVENTION

The present invention was the subject matter of Document Disclosure Program Registration No. 197,308 which was filed in the U.S. Patent and Trademark Office on Jul. 21, 1988.

As can be seen by reference to the following U.S. Pat. Nos.: 4,300,285; 4,395,822; 4,480,387; and, 4,226,019 the prior art is replete with myriad and diverse razor blade cleaning apparatus.

As anyone who has used a razor blade in general, and the newer twin bladed razors in particular, is aware the useful life of either a single or double bladed razor construction can be both extended and produce a much cleaner shave if the blade surfaces are kept free by periodically removing the accumulated cuttings and lather that are deposited on and around the cutting surface of the blades.

While all of the aforementioned prior art blade cleaning constructions are more than adequate for the basic purpose and function for which they have been specifically designed, these patented structures are uniformly deficient in both the complexity of their construction coupled wit the fact that they are integrally incorporated into the construction of the razor per se.

Obviously the consumer is paying a premium to recoup the cost of the design, development and manufacture of these structurally complicated arrangements which have a very limited useful life predicated by the length of time that the blades retain an edge that is sharp enough to shave hair.

As a consequence of the foregoing situation there has existed a longstanding need, particularly among those consumers that do not purchase self-purging twin blade razors for an independent cleaning implement that is specifically designed to clean razor blades; and, the provision of such a device is a stated objective of the present invention.

SUMMARY OF THE INVENTION

Briefly stated, the razor cleaning implement that forms the basis of the present invention comprises in general: a gripping unit which supports a blade unit.

As will be explained in greater detail further on in the specification, the gripping unit comprises an enlarged gripping member having recessed finger and thumb accomodating surface areas provided with raised projections which provide a relatively non-slip grasp for the users fingers. In addition, the upper and outer peripheral edges of the gripping member are provided with a collar portion which act as a guide and a centering means for the users thumb and forefinger.

The blade unit comprises an elongated thin discrete cleaning blade element which is dimensioned to pass between the blades of a twin blade razor to dislodge and remove any accumulated debris between the blades.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
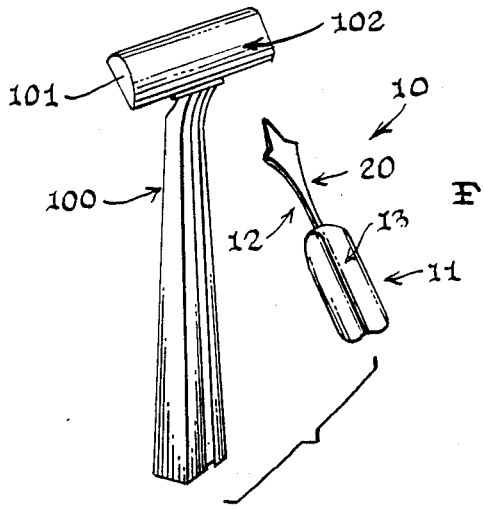
FIG. 1 is a perspective view of the blade cleaning implement in conjunction with a twin bladed razor.

As can be seen by reference to the drawings and in particular to FIG. 1, the razor cleaning implement that forms the basis of the present invention is designated generally by the reference numeral (10). The implement (10) comprises in general: a gripping unit (11) and a cleaning blade unit (12). These units will now be described in seriatim fashion.

As shown in FIGS. 2 thru 5, the gripping unit (11) comprises an enlarged gripping member (13) having central recessed portions (14) formed on opposite sides of the gripping member (13) wherein the central recessed portions are dimensioned to receive the users thumb and forefinger. In addition, the central recessed portions (14) are further provided with a plurality of raised ribs (15) which assist the users frictional grasp of the gripping member (13) when the gripping member is exposed to water and soap.

Figure 3:
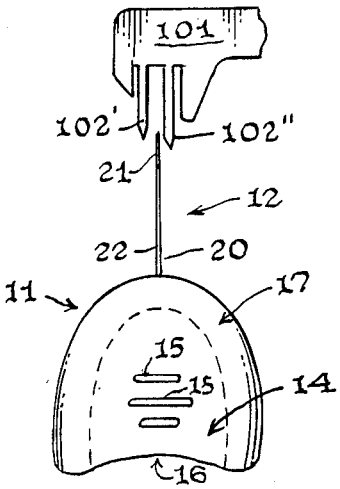
FIG. 3 is a front plan view of the implement with the cleaning blade unit disposed intermediate the upper and lower blades of a razor.
Figure 5:
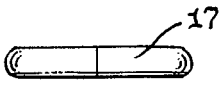
FIG. 5 is an isolated top plan view of the implement.
Figure 4:
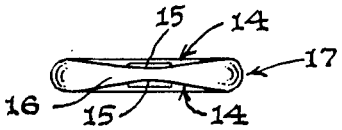
FIG. 4 is an isolated bottom plan view of the implement.

As can best be seen by reference to FIGS. 3 and 4, the gripping member (13) has a generally thin semi-circular configuration wherein the bottom portion (16) of the gripping member (13) is tapered and the upper and outer edges of the gripping member (13) are provided with an enlarged peripheral collar (17) which assists in the centering of the users thumb and finger while grasping the gripping unit (11).

As shown in FIGS. 1 thru 3 and 5, the cleaning blade unit (12) comprises an elongated thin cleaning blade member (20) having an enlarged cleaning head element (21) mounted on a tapered shaft element (22) which is affixed to the top portion (18) of the gripping member (13).

Figure 2:
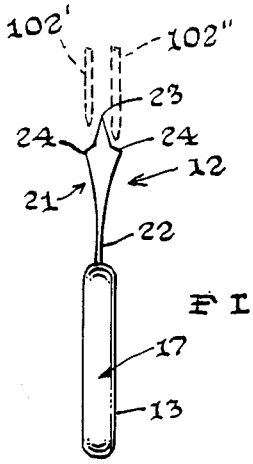
FIG. 2 is an isolated plan view of the implement.

Turning now particularly to FIG. 2, it can be appreciated that the enlarged cleaning head element (21) has an inwardly tapered point (23) which projects outwardly from opposed flared shoulders (24); wherein, the flared shoulders (24) can be employed to limit the depth of penetration of the tapered point (23) between the upper (102') and the lower (102'') blades (102) shown in phantom on the head (101) of a twin bladed razor (100).

As can also be seen by reference to FIG. 4, the cleaning blade member (20) can be oriented 90° from the orientation depicted in FIG. 2, such that the cleaning head element (21) can completely penetrate the space between the upper (102') and lower (102'') blades (102) on the head (101) of a twin bladed razor (100) to remove the accumulated debris between the blades (102).

Having thereby described the subject matter of this invention it should be apparent that many substitutions, modifications and variations of the invention are possible in light of the above teachings. It is there fore to be understood that the invention as taught and described herein is only to be limited to the extent of the breadth and scope of the appended claims.

I claim:

1. A razor cleaning implement for use in combination with a razor having a head and twin blades wherein the razor cleaning implement consists of:

a gripping unit comprising an enlarged gripping member that is dimensioned to be grasped by a users thumb and forefinger; wherein the gripping member is provided with a central recessed portion formed on the opposite sides of the gripping member wherein the central recessed portions are dimensioned to receive the users thumb and forefinger; wherein the central recessed portions are further provided with a plurality of raised ribs to assist the frictional grasp of the user relative to the gripping member; and, is further provided with an enlarged peripheral collar which at least partially surrounds the central recesses of the gripping member; and, a cleaning blade unit comprising an elongated generally flat and relatively rigid cleaning blade member having an enlarged cleaning head element attached to a stem which is affixed to the enlarged gripping member, wherein the cleaning blade element is provided with an inwardly tapered point which projects outwardly from opposed flared shoulders; whereby the opposed flared shoulders are dimensioned to limit the penetration of the tapered point relative to the space between the twin blades of the razor in one orientation of the implement; and, wherein in another orientation of the implement the tapered point will have unobstructed access relative to the space between the twin blades of the razor.

* * * * *